United States Patent [19]

Rothchild

[11] 4,377,173

[45] Mar. 22, 1983

[54] METHODS AND APPARATUS FOR EXPANDING TOBACCO

[75] Inventor: Ronald D. Rothchild, South Orange, N.J.

[73] Assignee: Airco, Inc., Montvale, N.J.

[21] Appl. No.: 244,847

[22] Filed: Mar. 18, 1981

Related U.S. Application Data

[62] Division of Ser. No. 13,484, Feb. 16, 1979, Pat. No. 4,308,876.

[51] Int. Cl.[3] ..... A24B 3/18

[52] U.S. Cl. ..... 131/291; 131/294; 131/295; 131/296; 131/900

[58] Field of Search ..... 131/291–296, 131/900

[56] References Cited

U.S. PATENT DOCUMENTS 4,250,898 2/1981 Utsch et al. ..... 131/291
4,253,474 3/1981 Hibbitts et al. ..... 131/291
4,258,729 3/1981 de la Burde et al. ..... 131/291

FOREIGN PATENT DOCUMENTS 1484536 9/1977 United Kingdom ..... 131/291

*Primary Examiner*—J. Millin
*Attorney, Agent, or Firm*—David L. Rae; Larry R. Cassett

[57] ABSTRACT

Tobacco impregnated with solid carbon dioxide is heated in a chamber to expand the same by sublimation of solid $CO_2$ and expulsion of $CO_2$ gas from the tobacco. The expanded tobacco is separated from the internal atmosphere of the expansion device and the tobacco is discharged through an outlet through which gas flows are substantially precluded. The evolved $CO_2$ gas and other volatile components are removed from the chamber and a portion of the removed gas is heated and returned to the chamber as the expansion medium. The necessity for external steam is avoided as an atmosphere of high thermal diffusivity is maintained in the expansion chamber by precluding the entry of ambient air.

11 Claims, 4 Drawing Figures

FIG. 3
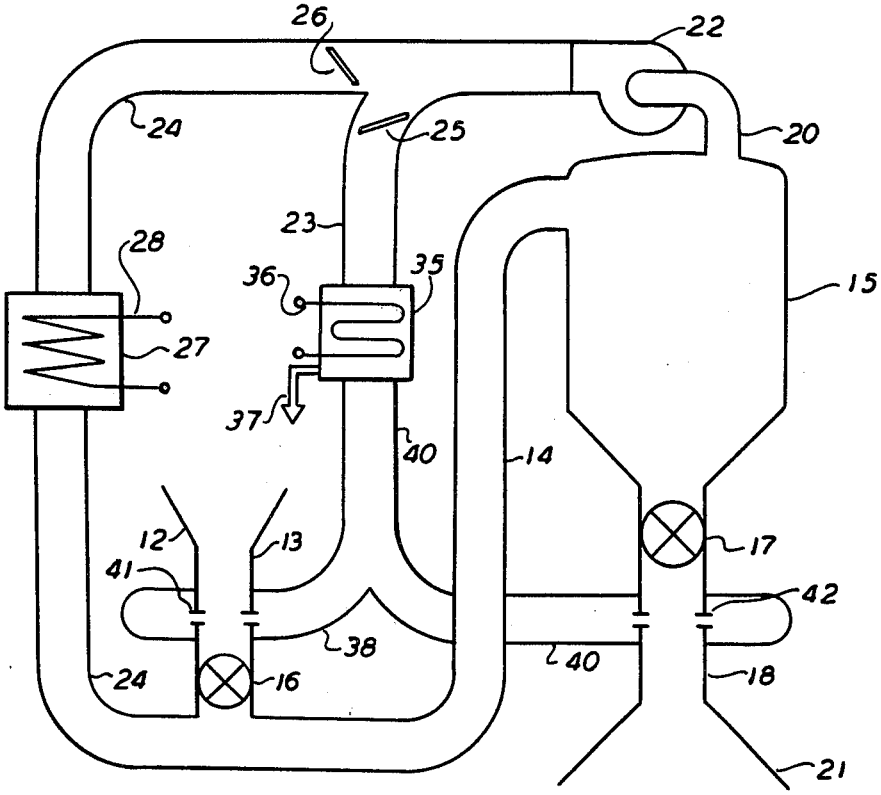
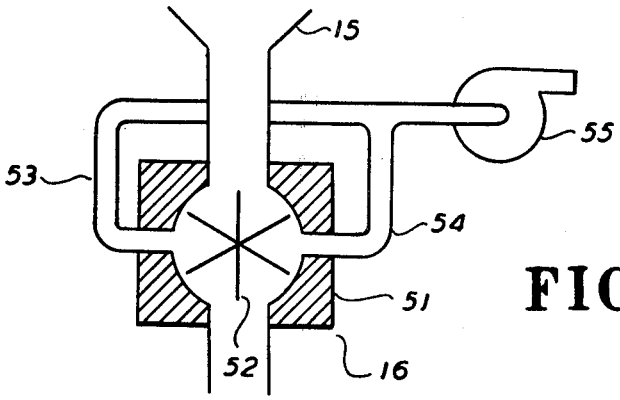
FIG. 4

METHODS AND APPARATUS FOR EXPANDING TOBACCO

BACKGROUND OF THE INVENTION

This is a devision of application Ser. No. 6/013,484, Feb. 16, 1979 now U.S. Pat. No. 4,308,876.

The present invention relates to tobacco expansion and more particularly to the preservation of high heat transfer atmospheres in tobacco expansion chambers.

In tobacco expansion processes, it is common to initially impregnate tobacco with an expansion agent such as carbon dioxide or inert organic liquids. Subsequent to impregnation, the tobacco is subjected to a stream of hot gases, typically steam, air, etc. thereby vaporizing liquid impregnants and subliming solid impregnants. The vapor phase of the impregnant is formed at a greater rate than the rate at which it escapes from the intercellular spaces in the tobacco and consequently the tobacco is blown up in size, i.e. expanded, from within. The application of positive heat to the impregnated tobacco will accelerate expansion as the rate of sublimation of a solid $CO_2$ impregnant, for example, will be more rapid. A process for so expanding with liquid $CO_2$ utilized as an impregnant is disclosed in U.S. Ser. No. 439,804, filed Feb. 5, 1974 and assigned to the assignee of the present invention. In this process, hot air is typically utilized as the expansion medium. U.S. Pat. Nos. 3,978,867 and 4,069,830 also disclose tobacco expansion processes utilizing hot air as the expansion medium.

The use of hot air as an expansion medium has its drawbacks, primarily the fact that air has a relatively low thermal diffusivity. As the degree of tobacco expansion is partially dependent upon the rate at which the impregnated tobacco is heated, it is desirable to retain a chamber atmosphere of a composition which is effective for heat transfer. Air alone is not the most effective expansion medium and compensation for such non-optimal atmospheres by raising atmosphere temperature is undesirable as excessive temperatures will result in scorching or other damage to the tobacco. As illustrated in U.S. Pat. Nos. 3,524,452 and 3,753,440, it has been proposed to improve heat transfer from a gaseous expansion medium such as freon and air by adding steam to the expansion chamber. While steam additions generally improve the rate at which tobacco can be expanded, steam generating equipment is costly and requires considerable quantities of energy for its operation. Thus, although steam exhibits a relatively high thermal diffusivity, the cost of producing steam may outweigh gains in expansion performance, e.g. about a 10% increase in expansion. It is also known to utilize steam heat in freeze-dry tobacco expansion processes, a typical one of such processes being illustrated in U.S. Pat. No. 3,991,772.

In automated tobacco expansion systems, impregnated tobacco is commonly expanded by contact with a stream of heated gases in an expansion tower and then passed with such gases to a separation device such as a cyclone separator. As illustrated in U.S. Pat. No. 3,524,452, gas phase effluent of the separation device is reheated and returned to the expansion tower. Tobacco is metered into the expansion tower and discharged from the separation device by means of mechanical solids feeding devices such as starwheel valves. Although the use of such valves enables continuous flows of tobacco to be sustained, these valves are relatively ineffective in precluding gas flows therethrough. Consequently, air is readily admitted into the expansion tower and separation device and becomes a significant component of the expansion medium, i.e. internal expansion chamber atmosphere. As the thermal diffusivity of air is relatively low in comparison to carbon dioxide or steam, the latter must frequently be added to expansion chambers to enable atmospheres of adequate thermal diffusivities to be achieved.

Accordingly, there is a need to efficiently expand tobacco impregnated with an expansion agent such as carbon dioxide without the use of steam and without resort to excessive temperatures in an expansion chamber.

OBJECTS OF THE INVENTION

It is an object of the invention to provide improved methods and apparatus for expanding tobacco.

It is a further object of the present invention to establish and maintain atmospheres of high thermal diffusivity in a tobacco expansion chamber.

It is another object of the invention to effect improved heat transfer to solid $CO_2$ impregnated tobacco in an expansion chamber without resort to excessive temperatures.

It is yet another object of the invention to recover volatile organic materials evolved from tobacco during expansion thereof.

Other objects of the present invention will become apparent from the detailed description of an exemplary embodiment thereof which follows, and the novel features of the invention will be particularly pointed out in conjunction with the claims appended hereto.

SUMMARY

In accordance with the invention, tobacco containing solid carbon dioxide is expanded by heating the same in an expansion chamber. Expansion is effected by sublimation of solid $CO_2$ with the resulting $CO_2$ gas blowing up tobacco from within. Carbon dioxide gas, together with volatilized water and organic materials, are evolved from tobacco into the expansion chamber to form a high thermal diffusivity atmosphere therein. As gas is added to the chamber during expansion, a portion of the atmosphere is continuously removed with the expanded tobacco and separated therefrom. A portion of the separated atmosphere may be exhausted to ambient with the remainder recycled to the expansion chamber. The recycled gas is preferably heated before the same is returned to the expansion chamber as the expansion medium. The tobacco outlet of the separation device is so arranged that substantially no gas flow occurs therethrough thereby precluding entry of atmospheric air into the separation device. In this manner, little, if any, atmospheric air will be recycled to the expansion chamber.

The portion of the expansion chamber atmosphere exhausted to atmosphere may first be cooled to effect condensation and recovery of volatile organic materials evolved from the tobacco undergoing expansion. Such recovered materials may be added to expanded tobacco in later stages, e.g. reordering, of the tobacco treatment process. The gas remaining after such condensation may be supplied to the vicinity of the tobacco inlet and outlet of the expansion chamber separation device, respectively, thereby substantially inhibiting entry of ambient air. In this manner, an atmosphere essentially comprised of carbon dioxide and steam volatilized from tobacco (high thermal diffusivity) is maintained in the chambers and efficient expansion of tobacco will be effected without resort to externally supplied steam or excessive and potentially damaging temperatures. Accordingly, the method and apparatus according to the invention will enable increased expansion of solid $CO_2$ containing tobacco without requiring steam or other costly expansion media.

BRIEF DESCRIPTION OF THE DRAWING

The invention will be more clearly understood by reference to the following description of exemplary embodiments thereof in conjunction with the following drawing in which:

FIGS. 2 and 3 are diagrammatic views of systems for expanding solid carbon dioxide containing tobacco in accordance with the invention; and FIG. 4 is a diagrammatic view of apparatus for inerting the tobacco inlets and exits of expansion chambers.

DESCRIPTION OF PREFERRED EMBODIMENT

Figure 1:
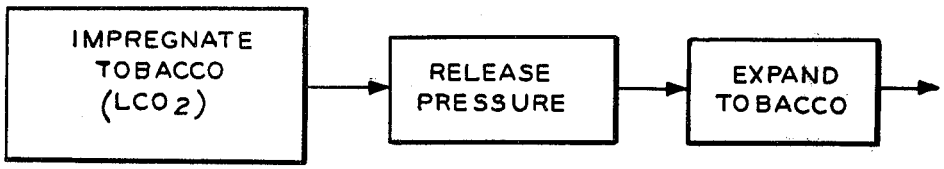
FIG. 1 is a block diagram of steps in a process for expanding tobacco with carbon dioxide.

Referring now to FIG. 1, illustrated therein is a block diagram of the functional steps of a process for expanding tobacco with carbon dioxide. As mentioned previously, such a process is described in application Ser. No. 439,804 filed Feb. 5, 1974. Briefly, in this process, tobacco, preferably in shredded form, is charged into a vessel into which "warm" liquid carbon dioxide is introduced under a pressure of approximately 400–1070 psia. The tobacco is immersed in and impregnated by the liquid $CO_2$, which is referred to hereinafter as an 'impregnant.' Subsequent to such impregnation, excess liquid $CO_2$ is removed from the vessel and the pressure in such vessel is reduced to substantially atmospheric pressure, thereby inherently causing the impregnated liquid carbon dioxide to be converted to the solid and gaseous phases. The solid $CO_2$ containing tobacco is then expanded by heating the same to rapidly sublime solid $CO_2$. Thus, $CO_2$ gas is generated within the tobacco more rapidly than it escapes and the tobacco is blown up from within. Typically, the expansion step of the process is performed in an expander or expansion chamber by introducing heated gases (e.g. air) or steam therein. As will be subsequently apparent, the present invention constitutes an improvement in the expansion step of the just described process.

Figure 2:
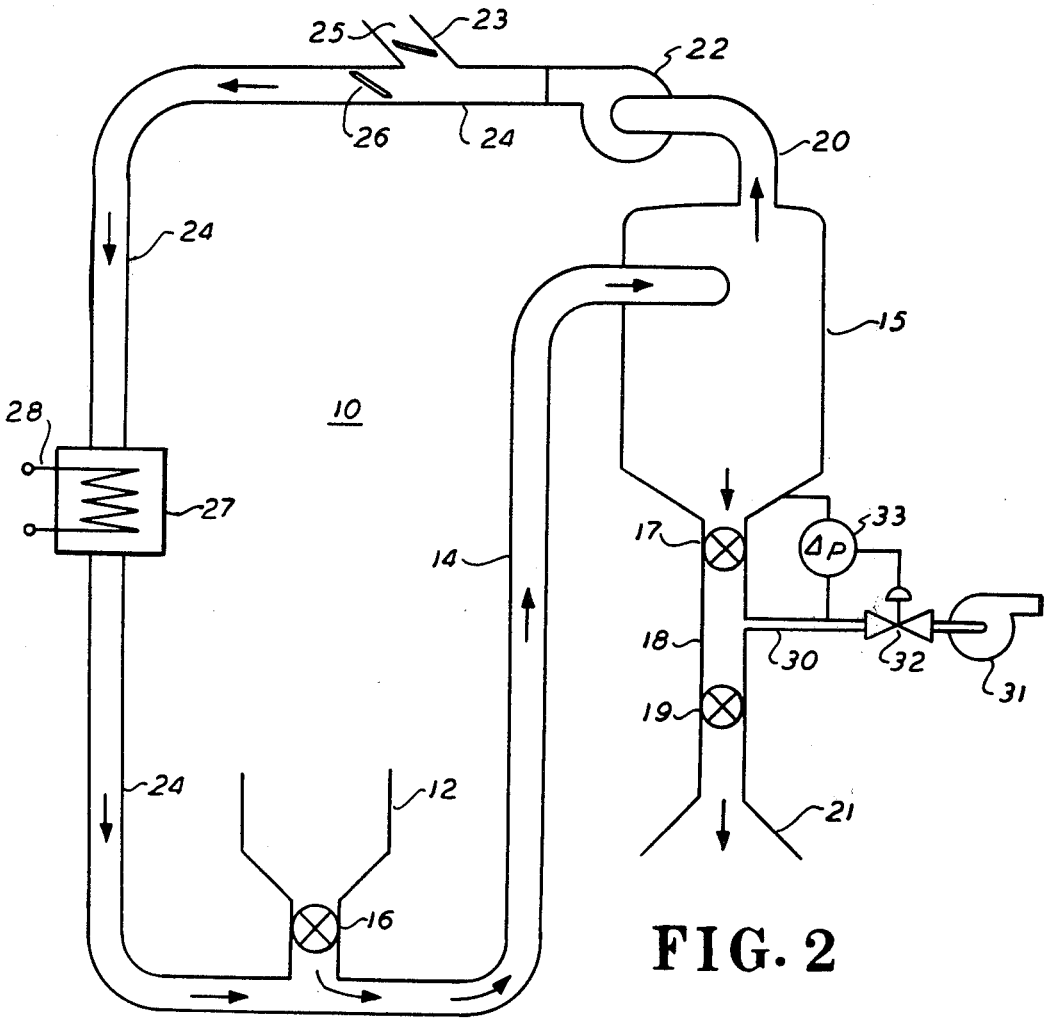

An exemplary embodiment of apparatus 10 for expanding solid carbon dioxide containing tobacco in accordance with the invention is illustrated in FIG. 2. An expansion chamber 14 which may take the form of a conventional tobacco expander or tower, is preferably provided with tobacco feeding means 16 at the tobacco inlet thereof. A hopper 12 is provided to direct solid $CO_2$ containing tobacco into feeding means 16 which preferably comprises a rotary starwheel valve device. Expander 14 is adapted to receive solid $CO_2$ containing tobacco carried in a heated gas stream supplied through conduit 24. Upon being heated in expansion chamber 14, solid $CO_2$ in the tobacco sublimes and is expelled outwardly to expand the tobacco. Thus, $CO_2$ gas is added to the internal atmosphere of the expansion chamber 14 and this atmosphere together with expanded tobacco is passed to separator device 15. A cyclone separator which is effective to achieve solid-gas separation may be utilized as device 15. Conduit 20 is provided with blower 22 disposed therein to enable venting of the atmosphere or expansion medium in chamber 14 which flows to separator 15 and to supply such gases either to exhaust conduit 23 or to a recycle conduit 24. The vented atmosphere will be comprised of carbon dioxide sublimed in chamber 14 together with volatilized moisture (steam) and organic materials evolved from tobacco being expanded therein.

A major portion of the removed atmosphere is recycled through conduit 24, heated by means of a suitable heating device 27 which may include electrical resistance heating elements 28, and is returned through conduit 24 to chamber 14. Furthermore, and very importantly, by returning to chamber 14 a portion of the atmosphere removed therefrom, the high thermal diffusivity characteristic of the atmosphere, primarily comprised of carbon dioxide and steam, is maintained. Consequently, increased expansion in size (typically increases of about 10%) will be attained by practice of the process according to the invention without resort to excessive and potentially tobacco damaging temperatures. In addition, the use of costly expansion media such as steam may be eliminated thereby improving the overall economics of the tobacco expansion process.

In order to maximize the benefits of high thermal diffusivity of the internal atmosphere of expansion chamber 14, it is important to both prevent loss of the desired atmosphere and the introduction of contaminants thereto. Thus, the losses of the desired atmosphere upon discharge of expanded tobacco and entry of ambient air into expansion chamber 14 through the tobacco feeder means 16 and outlet 17 must be minimized. It will be understood that outlet 17 may be comprise a starwheel valve device similar to feeder means 16.

Separation of tobacco and heated gases in separator 15 is facilitated by means of blower 22, the operation of which generates a slightly negative pressure (e.g. −2 p.s.i.g.) in conduit 20 and separator 15. In prior art tobacco expansion systems in which expanded tobacco is discharged through a starwheel valve to the ambient atmosphere, a pressure drop of up to as much as approximately 2 p.s.i.g. exists across such valve. This, in turn, results in the introduction of significant quantities of air through this valve into the separator device and the return of heated gases contaminated with air (low thermal diffusivity) to the expansion chamber. Although such an influx of air can be counteracted by steam additions, the cost of steam and associated generating equipment as mentined above increases the cost of the overall expansion process.

In accordance with the present invention, the influx of ambient air into separator 15 upon discharge of expanded tobacco through feeder means or outlet 17 is virtually eliminated. Outlet 17 communicates with a conduit or passage 18 in which a further feeder means 19 is provided. A suitable hopper 21 is disposed to receive tobacco discharged from feeder means 19 which may comprise a starwheel valve device. A conduit 30 is provided in communication with conduit 18 at a location intermediate feeder means 17 and 19. A pressure regulator 32 is disposed in conduit 30 which is connected to the suction side of blower 31. A pressure sensing device 33 is effective to detect the difference in pressures existing in separator 15 and conduit 30 and provides control signal to regulator 32 representative of such difference.

Operation of the embodiment of the invention illustrated in FIG. 2 will now be described. Solid carbon dioxide containing tobacco which is to be expanded is introduced through hopper 12 and feeder means 16 into the lower portion of expansion chamber 14. The tobacco is then carried upwardly through expansion chamber 14 by a stream of heated gases having a high thermal diffusivity characteristic. Such heated gases are preferably comprised of carbon dioxide and volatilized moisture and organic materials. As mentioned previously, as the solid carbon dioxide containing tobacco is heated in chamber 14, the solid $CO_2$ impregnant is sublimed to $CO_2$ gas and is released from the tobacco. As the rate of sublimation exceeds the rate at which gas escapes from the tobacco, the latter is blown up or expanded from within. In addition, moisture and organic materials will also be volatized from tobacco in chamber 14 and will be discharged therefrom along with expanded tobacco into separator 15. The gaseous phase of the mixture supplied to separator 15 is removed therefrom through conduit 20 by blower 22 which is effective to recirculate removed gases and to establish a suction pressure, i.e. a slightly negative pressure in separator 15.

Tobacco is discharged from separator 15 through feeder means 17 into conduit 18 which is isolated from ambient atmosphere and maintained at substantially the same pressure existant in separator 15. By connecting the suction inlet of blower 31 through a pressure regulator 32 and conduit 30, a negative pressure is maintained in conduit 18 and gas flow across feeder means 17 is virtually eliminated as the pressure on both sides of feeder means 17 is equalized. It will be understood that simply discharging tobacco to ambient atmosphere through feeder means 17 will inevitably result in the influx of air into separator 15 due to the pressure differential of 2 p.s.i.g. existing across feeder means 17. This influx of air will occur notwithstanding use of a starwheel valve due to clearances between teeth or vanes of such valves and internal housing surfaces. As noted previously, air exhibits a relatively low thermal diffusivity and its introduction into separator 15 degrades the heat transfer qualities of the gas therein, which gas is vented and recirculated to expansion chamber 14 for re-use as an expansion medium. However, by providing a second feeder means 19 and reducing the pressure in conduit 18 between feeder means 17 and 19 as illustrated in FIG. 2, the internal volume of separator 15 is essentially isolated from ambient atmosphere during the discharge of expanded tobacco into hopper 21.

Differential pressure sensing means 33 is effective to supply a control signal to pressure regulator 32 which in turn regulates the pressure on conduits 30 and 18. This, in the event the pressure in conduits 30 and 18 increases to a level above the pressure in separator 15, e.g. above about −2 p.s.i.g., regulator 32 will be effective to establish a lower pressure in conduits 30 and 18. In essence, regulator 32 operates as a control valve and opens to enable a lower pressure to be established in conduits 30 and 18 under the influence of blower 31.

It will be understood that by substantially precluding gas flows through feeder means 17 the desired atmosphere of carbon dioxide and volatilized moisture and organic materials is retained in separator 15 while ambient air is excluded upon discharge of expanded tobacco. The particular arrangement of feeder means 17 and 19 as illustrated in FIG. 2 enables a pressure equalization across feeder means 17 while permitting a continuous discharge of expanded tobacco. Any ambient air admitted into conduit 18 upon operation of feeder means 19 will be removed through conduit 30 by blower 31. By excluding air from separator 15, the thermal diffusivity of the gases withdrawn through conduit 20 will be satisfactory to enable expansion of solid $CO_2$ containing tobacco in chamber 14 without external steam additions.

The gases or expansion medium withdrawn by blower 22 from separator 15 are discharged into a suitable conduit 24 typically at a positive pressure of about 1.0 p.s.i.g. A vent 23 is provided to vent a portion of the discharged gases to atmosphere. Since $CO_2$ gas, volatilized moisture, etc, are continually released into expansion chamber 14 and are passed into separator 15, it is necessary to continuously vent excess gas from apparatus 10. A damper 25 disposed in vent 23 is effective to maintain a slightly positive pressure in conduit 24 while damper 26 may be adjusted to enable the flow of gases recirculated through conduit 24 to be controlled to a predetermined value. There will, of course, be an unavoidable drop in pressure of gas flowing through conduit 24 and by adjustment of damper 25, the pressure of such gas may be established so that in the vicinity of feeder means 16, the pressure in conduit 24 is essentially atmospheric. In this manner, the pressure across feeder means 16 will be equalized as hopper 12 is generally in communication with ambient and essentially no gas flow will occur across feeder means 16. Accordingly, little if any air, which tends to reduce the thermal diffusivity of the gases recirculated through conduit 24, is admitted therein. The use of external steam to increase the thermal diffusivity of the atmosphere within chamber 14 is rendered unnecessary. Also, by so avoiding the use of external steam, the tendency to dilute the concentration of volatilized organic material will be averted and such materials can be condensed more effectively.

With reference to FIG. 3, illustrated therein is a further embodiment of an expansion chamber 14 and separation device 15. The tobacco inlet of chamber 14 and outlet of device 15 are positively inerted thereby substantially excluding ambient air from chamber 14. Conduit 20 is effective to place the upper portion of separation device 15 in communication with the suction side of blower 22 which in turn vents the separated medium from device 15. A portion of this medium, which is comprised of carbon dioxide gas and volatilized moisture (steam) and organic materials may be recycled through conduit 24 and heater 27 (having a suitable heating element 28 disposed therein) to chamber 14. The remainder of the expansion medium vented by blower 20 from device 15 is exhausted through conduit 23 and is supplied to cooling means 35. The pressure in conduit 24 will be controlled by the setting of flap or damper 25 while the flow therethrough will be controlled by the setting of damper 26. Cooling means 35, which preferably includes a coil 36 through which a refrigerant such as cold water, freon, etc. is caused to flow, is effective to condense volatile organic matter evolved from tobacco during the expansion thereof in chamber 14. Consequently, such materials which are of value may be recovered in drain 37 for subsequent tobacco treating operations such as reordering.

The non-condensed expansion medium leaving cooling means 35 is passed through conduit 40 which is preferably disposed about the tobacco inlet 13 of expansion chamber 14 above feeder means 16 but below hopper 12. Conduit 40 is also disposed in communication with the inlet side of feeder means 16 by means of a suitable aperture 41. Conduit 40 also extends to the vicinity of the tobacco outlet 18 of separator device 15 below the oulet side of feeder means 17 and above outlet hopper 21. Communication between the tobacco conduit 18 and conduit 40 is effected by means of suitable apertures 42.

The gas stream leaving cooling means 35 will pass through conduit 40 and apertures 41 and 42 into tobacco inlet 13 and outlet 18, respectively. Any leakage of gas inwardly through feeder means 16 and 17 into chamber 14 or separator device 15, respectively, will thus be comprised of the essentially carbon dioxide-steam gas stream supplied through conduit 40. Consequently, ambient air will be virtually precluded from entering chamber 14 and an atmosphere of high thermal diffusivity will be maintained therein without requiring external media such as steam, etc. Accordingly, the apparatus illustrated in FIG. 3 is not only effective to establish desirable atmosphere in chamber 14 for the efficient expansion of solid $CO_2$ containing tobacco, but in addition volatile materials evolved from such tobacco during expansion are recovered and are thus available for subsequent tobacco treatment. By inerting tobacco inlet 13 in the manner described above, less precise control over dampers 25 and 26 may be effected. In the absence of inerting, such dampers must be adjusted to establish virtually atmospheric pressure just inside feeder means 16 and by failing to precisely adjust dampers 25 and 26, ambient air may be introduced into expansion chamber 14.

In order to substantially preclude entry of atmospheric air into expansion chamber 14 illustrated in FIGS. 2 and 3, respectively, feeder means 16 and 17 may be subjected to a slight negative pressure as illustrated in FIG. 4 and as will now be described. As mentioned previously, feeder means 16 and 17 will typically comprise starwheel devices which are effective to pass solid $CO_2$ containing tobacco into an expansion chamber or remove expanded tobacco from a separation device. The ability of such feeder means in excluding ambient air from the expansion chamber, etc. can be improved by removing atmosphere internally of the starwheel device through conduits in FIG. 4. The flow of removed atmosphere recycled by blower 22 is then somewhat reduced with respect to typical flow recycled by this blower in the system illustrated in FIGS. 2 and 3. Conduits 53 and 54 extend through housing 51 of feeder means 16 for example and are in communciation with the interior cavity thereof in which starwheel 52 rotates. Vacuum pump 55 is effective to remove the atmosphere of this internal cavity and thus prevent entry of air flows into chamber 14 or separation device 15. Consequently, the use of externally supplied steam to improve the thermal diffusivity of the atmosphere of expansion chamber 14 is unnecessary.

Although exemplary embodiments of the present invention have been described as systems for continuously expanding solid $CO_2$ containing tobacco, such tobacco can be expanded on a batch basis with a recycle of expansion chamber atmosphere as described above.

The foregoing and other various changes in form and details may be made without departing from the spirit and scope of the present invention. Consequently, it is intended that the appended claims be interpreted as including all such changes and modifications.

I claim:

1. Apparatus for expanding solid carbon dioxide containing tobacco comprising an expansion chamber, means for introducing said solid carbon dioxide containing tobacco into said expansion chamber; means for heating the atmosphere in said expansion chamber to thereby expand said tobacco and form a chamber atmosphere comprised substantially of carbon dioxide gas and volatilized moisture and organic materials; means connected to said expansion chamber for separating expanded tobacco from said chamber atmosphere; means for discharging expanded tobacco from said separating means; and means for substantially precluding gas flows through said expanded tobacco discharge means.

2. The apparatus defined in claim 1 wherein said means for discharging expanded tobacco comprises a starwheel feeder device disposed at a tobacco outlet of said separating means and said means for substantially precluding gas flows comprise means for equalizing the pressure externally of said feeder device with the pressure internally of said separating means thereby substantially precluding the entry of ambient air into said separating means and the discharge of said chamber atmosphere therefrom.

3. The apparatus defined in claim 2 wherein said means for equalizing pressure comprise a conduit into which said starwheel feeder device discharges expanded tobacco, a further starwheel feeder device disposed in said conduit and spaced from said starwheel feeder device and means communicating with said conduit intermediate said starwheel feeder devices and further means for applying a pressure to said conduit substantially equal to the pressure in said separating means.

4. The apparatus defined in claim 3 additionally comprising means for sensing the pressure in said separating means and means responsive to said sensed pressure to substantially equalize the pressure in said conduit intermediate said starwheel feeder device with the pressure in said separating means.

5. The apparatus defined in claim 4 additionally comprising means for venting said separated chamber atmosphere from said separating means whereby a slightly less than atmospheric pressure ie established therein and means for recycling at least a portion of said vented chamber atmosphere to said expansion chamber.

6. The apparatus defined in claim 5 wherein said means for equalizing pressure comprise means for applying a vacuum pressure to said conduit intermediate said starwheel feeder device and said further starwheel feeder device means.

7. The apparatus defined in claim 6 additionally comprising means for heating said recycled chamber atmosphere and means for controlling the pressure of said recycled chamber atmosphere.

8. The apparatus defined in claim 1 wherein said discharge means comprises a starwheel device mounted in the internal cavity of a housing and said means for precluding gas flows comprise means for withdrawing atmosphere from said cavity such that ambient air drawn into said cavity is precluded from entering said separating means.

9. Apparatus for expanding solid carbon dioxide containing tobacco in an expansion chamber to produce a chamber atmosphere comprised of carbon dioxide gas and volatilized moisture and organic materials comprising inlet means disposed in a first conduit for introducing solid carbon dioxide containing tobacco into said chamber; means for heating the atmosphere in said chamber to thereby expand said tobacco and form a chamber atmosphere comprised of carbon dioxide gas and volatilized moisture and organic materials; means connected to said chamber for separating expanded tobacco from said chamber atmosphere; outlet means disposed in a second conduit for discharging expanded tobacco from said separating means; means for dividing said vented chamber atmosphere into first and second flows; means for condensing volatile organic materials in said first flow and means for supplying the non-condensed remainder of said first flow to said first conduit exteriorly of said tobacco inlet with respect to said chamber and to said second conduit exteriorly of said outlet means with respect to said separating means thereby substantially isolating said tobacco inlet and outlet means from ambient air.

10. The apparatus defined in claim 9 further comprising means for returning said second flow to said expansion chamber.

11. The apparatus defined in claim 9 wherein said conduits are provided with apertures through which said non-condensed remainder of said first flow passes.

* * * * *